US009211538B2

(12) United States Patent
Weber

(10) Patent No.: US 9,211,538 B2
(45) Date of Patent: Dec. 15, 2015

(54) MICROFLUID STORAGE DEVICE

(75) Inventor: Lutz Weber, Homburg (DE)

(73) Assignee: THINXXS MICROTECHNOLOGY AG, Zweibrücken (DE)

( * ) Notice: Subject to any disclaimer, the term of this patent is extended or adjusted under 35 U.S.C. 154(b) by 407 days.

(21) Appl. No.: 12/734,950

(22) PCT Filed: Dec. 5, 2008

(86) PCT No.: PCT/DE2008/002061

§ 371 (c)(1),
(2), (4) Date: Aug. 23, 2010

(87) PCT Pub. No.: WO2009/071078

PCT Pub. Date: Jun. 11, 2009

(65) Prior Publication Data

US 2010/0308051 A1 Dec. 9, 2010

(30) Foreign Application Priority Data

Dec. 6, 2007 (DE) ..... 10 2007 059 533

(51) Int. Cl.
*B65D 41/32* (2006.01)
*B01L 3/00* (2006.01)

(52) U.S. Cl.
CPC ..... *B01L 3/502738* (2013.01); *B01L 3/502715* (2013.01); *B01L 2200/0605* (2013.01); *B01L 2200/16* (2013.01); *B01L 2300/087* (2013.01); *B01L 2300/0809* (2013.01); *B01L 2300/0816* (2013.01); *B01L 2300/0864* (2013.01); *B01L 2300/0867* (2013.01); *B01L 2300/0877* (2013.01); *B01L 2300/123* (2013.01); *B01L 2400/0481* (2013.01); *B01L 2400/0683* (2013.01)

(58) Field of Classification Search
USPC ..... 222/94, 136, 145.1, 145.5, 206, 541.4, 222/212, 207, 209, 105, 95, 541.3, 541.6
See application file for complete search history.

(56) References Cited

U.S. PATENT DOCUMENTS

| | | | | |
|---|---|---|---|---|
| 2,707,581 | A | 12/1954 | Kaplan et al. | |
| 3,173,580 | A * | 3/1965 | Campbell | 222/107 |
| 3,635,376 | A | 1/1972 | Hellstrom | |
| 3,750,907 | A * | 8/1973 | Steele | 222/107 |
| 4,303,751 | A * | 12/1981 | Campbell et al. | 430/208 |

(Continued)

FOREIGN PATENT DOCUMENTS

| | | | |
|---|---|---|---|
| DE | 3900702 | Y | 4/1990 |
| DE | 19962436 | Y | 7/2001 |

(Continued)

*Primary Examiner* — Donnell Long
(74) *Attorney, Agent, or Firm* — Lucas & Mercanti, LLP; Klaus P. Stoffel

(57) ABSTRACT

The invention relates to a microfluid storage device having at least one supply chamber (5) formed by bulging a film (7) or membrane (19), a target break point (10) for forming an opening in the supply chamber (5), and a transport path (9) leading from the supply chamber (5) to an opening (11) in the supply chamber, for example, an interface between the storage device and a microfluid processing unit (2). According to the invention, the initially closed transport path (9) may be opened to form a transport channel (15) corresponding to the fluid stream escaping from the supply chamber (5), preferably by the escaping fluid itself, which allows the fluid to be removed from the storage device in a bubble-free manner.

8 Claims, 5 Drawing Sheets

(56) References Cited

U.S. PATENT DOCUMENTS

| | | | | |
|---|---|---|---|---|
| 4,331,264 | A * | 5/1982 | Staar | 222/94 |
| 4,592,493 | A | 6/1986 | Smith | |
| 4,890,744 | A * | 1/1990 | Lane, Jr. et al. | 222/107 |
| 4,952,068 | A | 8/1990 | Flint | |
| 5,009,894 | A * | 4/1991 | Hsiao | 424/451 |
| 5,050,736 | A * | 9/1991 | Griesbach et al. | 206/484 |
| 5,215,221 | A * | 6/1993 | Dirksing | 222/94 |
| 5,814,159 | A * | 9/1998 | Paley et al. | 134/6 |
| 5,839,609 | A * | 11/1998 | Zakensberg | 222/107 |
| 6,105,761 | A * | 8/2000 | Peuker et al. | 206/229 |
| 6,357,631 | B1 | 3/2002 | Zaksenberg | |
| 6,685,013 | B2 * | 2/2004 | Discko, Jr. | 206/229 |
| 6,935,492 | B1 * | 8/2005 | Loeb | 206/219 |
| 7,004,354 | B2 * | 2/2006 | Harper | 222/94 |
| 7,374,040 | B2 * | 5/2008 | Lee et al. | 206/229 |
| 7,552,823 | B2 * | 6/2009 | Schuehrer | 206/484 |
| 7,607,534 | B2 * | 10/2009 | Peuker et al. | 206/229 |
| 7,644,821 | B2 * | 1/2010 | Perell | 206/532 |
| 7,669,597 | B2 * | 3/2010 | Sullivan et al. | 128/203.21 |
| 7,757,893 | B2 * | 7/2010 | Perell | 222/107 |
| 7,875,016 | B2 * | 1/2011 | Pahlberg et al. | 604/410 |
| 7,909,165 | B2 * | 3/2011 | Perell | 206/532 |
| 8,048,375 | B2 * | 11/2011 | Breidenthal et al. | 422/68.1 |
| 2003/0146117 | A1 * | 8/2003 | Raia et al. | 206/229 |
| 2006/0057030 | A1 | 3/2006 | Lee et al. | |
| 2006/0131189 | A1 * | 6/2006 | Lee et al. | 206/229 |
| 2007/0119862 | A1 * | 5/2007 | Backes et al. | 222/94 |

FOREIGN PATENT DOCUMENTS

| | | | |
|---|---|---|---|
| DE | 10009623 | Y | 10/2001 |
| DE | 10056212 | XY | 5/2002 |
| DE | 202004000591 | XY | 4/2004 |
| DE | 10336850 | X | 3/2005 |
| EP | 0583833 | X | 2/1994 |
| JP | 2000007027 | Y | 1/2000 |
| WO | 02068823 | A | 9/2002 |
| WO | 2007002480 | A | 1/2007 |
| WO | 2007130703 | Y | 11/2007 |

* cited by examiner

MICROFLUID STORAGE DEVICE

The invention relates to a microfluidic storage device with at least one storage chamber for a fluid formed by bulging of a foil or diaphragm, an intended breaking point for forming an opening of the storage device, and a transport path which extends from the storage chamber to an opening of the storage device, for example, at a point of intersection between the storage device and a microfluidic processing device.

In addition to storing, such a storage device serves for the transportation and/or targeted release of fluids. In connection with the processing device, it can be used, for example, for the analysis of fluids (gases and liquids) in medical diagnostics and analysis as well as environmental analysis.

A storage device of the above-mentioned type is known from WO/002007002480A2. When exerting pressure against a flexible wall of the supply chamber, the intended breaking point breaks under the pressure of the fluid and the fluid can flow to the aforementioned opening through a duct which forms the transport path. When the intended breaking point breaks suddenly, a strong pressure variation occurs and the fluid is discharged in batches. In addition, there is the danger that the batch-wise discharge of the fluid causes air bubbles to be formed in the transport path because the air present in the transport duct cannot be completely displaced. The uncontrolled entrainment of the air bubbles constitutes a significant impairment of the function of the fluid when further processed in the fluidic processing device.

It is the object of the invention to provide a new microfluidic storage device of the above-mentioned type which facilitates a more precise metering of the fluid quantities to be removed therefrom and which particularly avoids the formation of air bubbles. Moreover, additional possibilities of using the transport bath are to be determined.

The storage device which meets this object according to the invention is characterized in that the transport path is connectable to a transport duct in accordance with the fluid flow emerging from the supply chamber.

In accordance with the invention, the transport path itself practically has no volume when the supply chamber is closed. Widening into a duct takes place preferably through the fluid itself which is under pressure only when the fluid is removed from the supply container. In this manner, the fluid, for example, a reaction liquid to be processed in a flow cell, can be removed in a metered manner and without bubbles from the storage device, and moreover, the transport path can be utilized, for example, as valve.

The intended breaking point it preferably arranged immediately at the supply chamber. And the transport path extends from the intended breaking point to the opening at the aforementioned point of intersection. Alternatively, the intended breaking point could be formed by the transport path itself, as shall be explained further below.

In accordance with a preferred embodiment of the invention, the transport path has duct walls which rest against each other or can be placed against each other, wherein at least one wall of the duct walls can be deformed by the fluid with the formation of the transport duct.

In particular, the wall can be expandable by the fluid for forming the transport duct.

The duct walls are preferably each formed by a flexible foil or diaphragm or by a flexible foil and a stiff plate.

The above-mentioned foils or the foil and the plate are in the area of the transport path not connected to one another or are connected with a weaker connection than in the adjacent areas. The latter connection may be so weak that it breaks under the pressure of the fluid. In this manner, the transport path itself can serve as the intended breaking point.

The storage device according to the invention may be integrated into the aforementioned microfluidic processing device.

The transport path may comprise several sections, between which, for example, a container is arranged.

This may involve a measuring container or a reactant, particularly a dry reactant, contained in the container.

In a further development of the invention, the transport paths of several storage containers have a common section extending, for example, from a mixing chamber to the aforementioned opening at the point of intersection.

Moreover, the transport path may have several sections which extend parallel to each other or in rows which extend, for example, from a distribution chamber to several openings at the point of intersection.

In the following the invention will be explained in more detail with the aid of embodiments and the enclosed drawings which refer to these embodiments.

Figure 1:
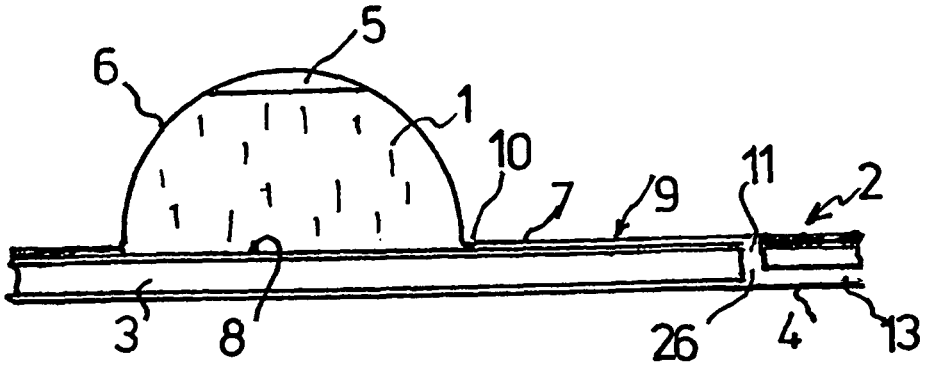
FIG. 1 is a first embodiment for a storage device according to the invention in a sectional side view.
Figure 2:
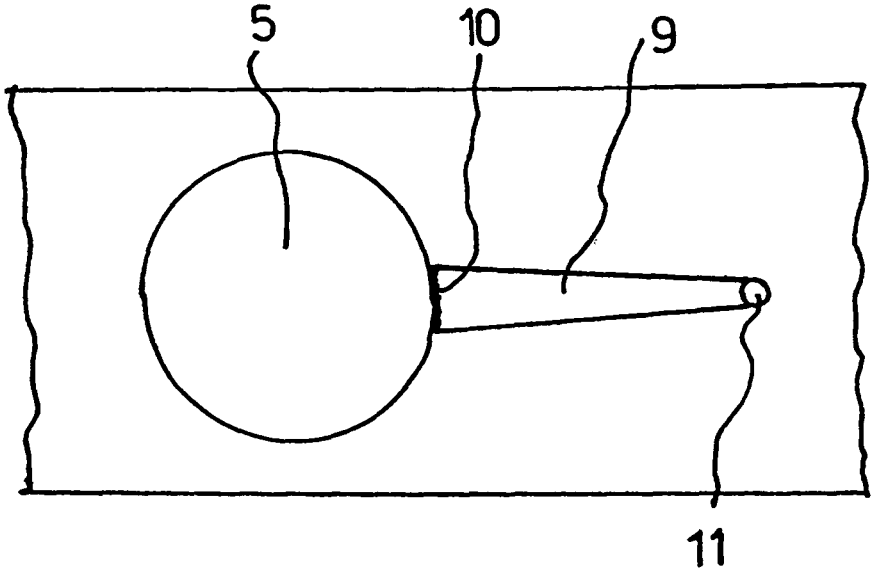
FIG. 2 is a top view of the storage device of FIG. 1.

A storage device illustrated in FIG. 1 for storing a fluid 1 is connected to the fluid 1, for example, as a reactant processing flow cell 2 which includes a base plate 3 and a lower cover foil 4.

The storage device includes a supply chamber 5 for the fluid 1 which is formed by a deep-drawn bulge 6 in a foil 7 and a foil 8 connected to the foil 7 for covering the bulge 6.

Figure 3:
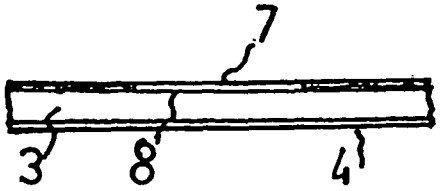
FIG. 3 is a view of a detail of the storage device of FIGS. 1 and 2.

With the exception of the area of the supply chamber 5 and the area of the transport path 9, the foils 7 and 8 are connected to each other over the entire surface area thereof, for example, by welding or gluing. This can be seen particularly in FIG. 3, in the area of the transport path 9, the foil 7 and 8 only rest against each other. A narrow welding or gluing area which forms an intended breaking point 10 separates the inner space of the supply chamber 5 from the transport path 9. Deviating from the embodiment being described presently, the foils 7 and 8 do not have to be connected to each other outside of the supply chamber and the transport path. It is sufficient to provide a connecting area defining the supply chamber and the transport path, wherein the connecting area withstands the application of pressure more than the intended breaking point 10.

The transport path 9 leads to a passage opening 11 in the foil 8 which is preferably congruent with a passage opening 26 in the base plate 3. The width of the transport path continuously decreases from the intended breaking point 10 to the through opening 11. The storage device is glued to the base plate 3 over the foil 8.

The through opening 26 in the base plate 3 leads to a duct 13 in the flow cell 2 which ends, for example, at a reaction chamber containing the fluid 1, not shown.

Figure 4:
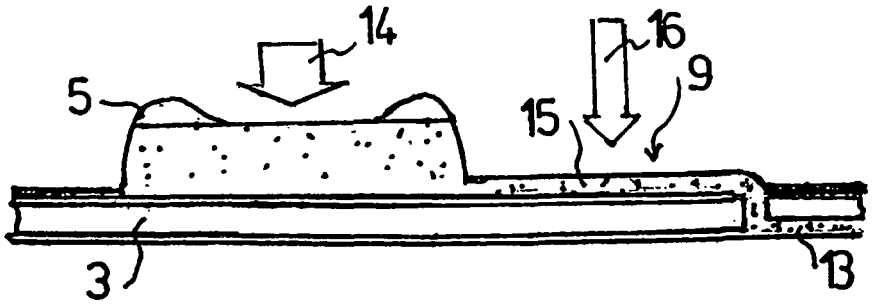
FIG. 4 is an illustration of the storage device of FIG. 1 shown during the removal of a stored fluid.
Figure 5:
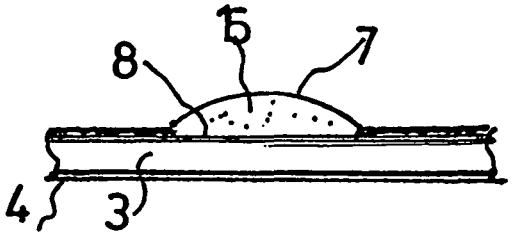
FIG. 5 is a view of a detail of the storage device shown in FIG. 4.

For introducing the stored fluid 1 into the flow cell 2 which processes the fluid the supply chamber 5 which thus far has been hermetically sealed in accordance with arrow 14 (FIG. 4) is compressed wherein the intended breaking point 10 breaks under the pressure of the fluid 1. The pressurized fluid 1 finds a transport duct 15 as a result of the foil 7 being deformed under expansion, as illustrated in FIG. 5. The fluid 1 finally travels through the through openings 11 and 26 through the duct 13 in the flow cell 2 which is covered by the foil 4.

Since the initial volume of the transport path 9 with the hermetically closed supply chamber 5 is at zero, and the fluid 1 emerging from the supply chamber under pressure itself only forms the internal volume of the transport path 9 and find a transport duct 15, no air bubbles can be formed in and the fluid 1 emerging from the supply chamber under pressure forms the inner volume of the transport path 9 and finds a transport duct 15, no air bubbles can be formed in the fluid flow which could impair the processing and/or function of the fluid 1 in the flow cell 2.

Advantageously, the above-described storage device makes it possible to obtain a very precise metering of individual partial quantities of the fluid 1 stored in the supply chamber 5. If the pressure is taken back as shown by arrow 14, and the fluid flow the transport path closes as a result of the elastic restoring force of the foil 7 and the fluid flow transferred into the flow cell stops. Alternatively, the fluid flow could be stopped by a locking element, in the simplest case in the form of a die, which acts on the transport path 9 in accordance with arrow 16, so that the transport path can be utilized with the locking element as a valve, so that the removal of desired partial quantities of the stored fluid supply is possible.

If the pressure acting on the supply chamber in accordance with arrow 14 remains, the locking element according to arrow 16 Acts as proportional valve. Depending on the position of the locking element, the pressurized valve can form the cross-section of the transport path with different widths, so that the flow velocity of the fluid can be controlled.

If the base plate 3 with the cover foil 4 has a breakthrough in the area of the locking element, the valve function can be constructed even more efficiently independently of the strength and stiffness of the base plate which otherwise form a counter bearing, by means of a second locking element which can be pushed out in the opposite direction.

In deviating from the embodiment described above with the aid of FIGS. 1 through 5, the foil 8 could be omitted and the foil 7 could be connected directly with the base plate 3, so that the bulge 6 and the transport path 9 are defined directly by the base plate 3 on one side thereof.

In the remaining Figures, the parts which are the same or act the same are provided with the same reference numerals, wherein the respective reference numeral additionally has a letter a, b etc.

Figure 6:
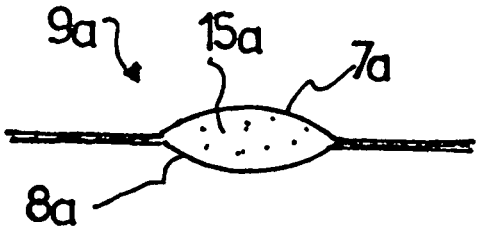
FIG. 6 is an illustration of an embodiment for a transport path of a storage device according to the invention in a cross-sectional view.

FIG. 6 shows an embodiment for a transport path 9*a* which is formed by a foil 7*a* and a foil 8*a*, wherein the foils are glued or welded together outside of the transport paths 9*a*, as in the embodiment according to FIGS. 1 to 5. In deviating from this embodiment, both foils have room for deformation, particularly when subjected to expansion, so that they can form a transport path 15*a* with walls that are curved on both sides. In accordance with the stiffness of the foils 7*a* and 8*a*, a symmetrical or asymmetrical curvature may be obtained.

Figure 7:
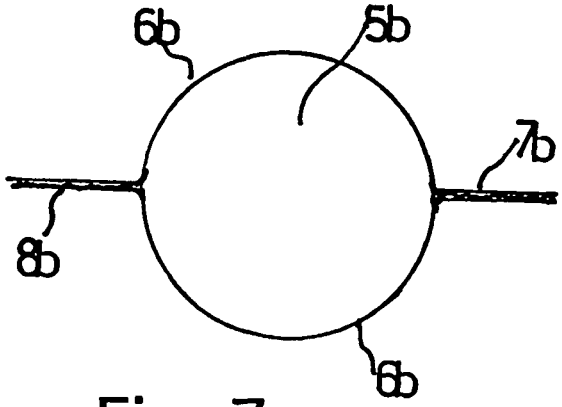
FIG. 7 is an illustration of an embodiment for a supply chamber of a storage device according to the invention in a sectional view.

In the same manner, as seen in FIG. 7, a supply chamber 5*b* could be formed by two foils 7*b* and 8*b* with a bulge each. The bulges may have different shapes and dimensions, depending on the deep-drawing tools which are used during cold or hot deep-drawing.

In the same manner, as seen in FIG. 7, a supply chamber 5*b* could be formed by two foils 7*b* and 8*b* with a bulge 6*b* or 6*b*' each. The bulges may have different shapes and dimensions, depending on the deep-drawing tools used for cold drawing or hot drawing.

The shape of the supply chamber may deviate from the chamber illustrated in FIGS. 1 to 5 and may not be round but, for example, oblong.

Figure 8:
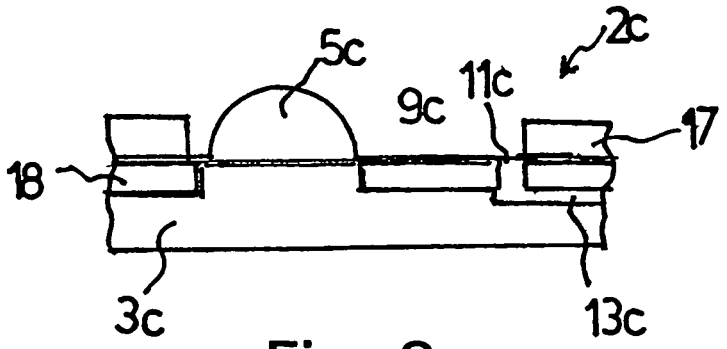
FIGS. 8 to 10 show different storage devices according to the invention which are integrated into a flow cell in a sectional side view.

A storage device illustrated in FIG. 8 with a supply chamber 5*c* and a transport path 9*c*, which corresponds approximately to the storage device described in FIGS. 1 to 5, is integrated into a flow cell 2*c*. The flow cell has a stepped base plate 3*c* as well as a cover plate 17. The storage device is defined between the cover plate 17 and a layer 18 of elastomer material which rests on the base plate 3*c*.

Figure 9:
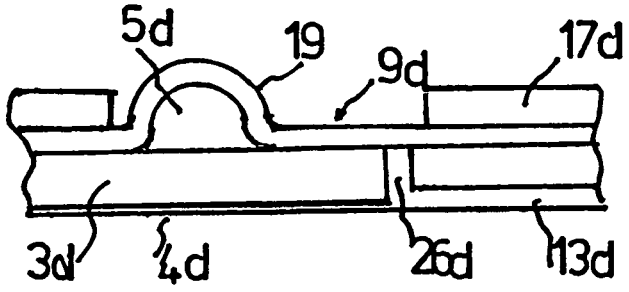

In the embodiment of FIG. 9, an elastic diaphragm 19 forms a storage device. The elastic diaphragm is composed, for example, of a thermoplastic elastomer and/or silicon material. A transport path 9*d* is defined by the diaphragm 19 and a base plate 3*d*.

Figure 10:
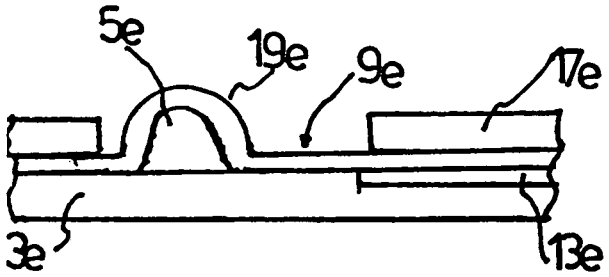

The embodiment of FIG. 10 differs from the preceding embodiments in that no through opening 26*a* is formed through the base plate, but rather a duct 13*e* follows a transport path 9*e* immediately.

Figure 11:
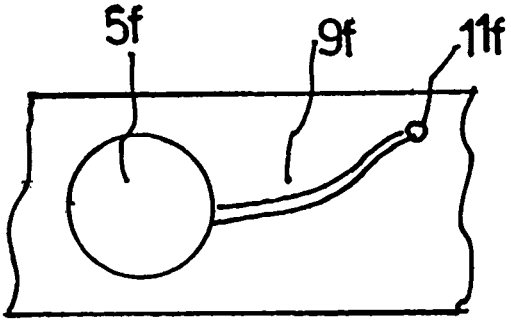
FIGS. 11 to 14 show additional embodiments for storage devices according to the invention in a top view.

FIG. 11 shows a storage device with a supply chamber 5*f* and a transport path 9*f* in a top view. In deviating from the preceding embodiments, the transport path is not straight but curved, so that an outlet opening is arranged at the desired location.

Figure 12:
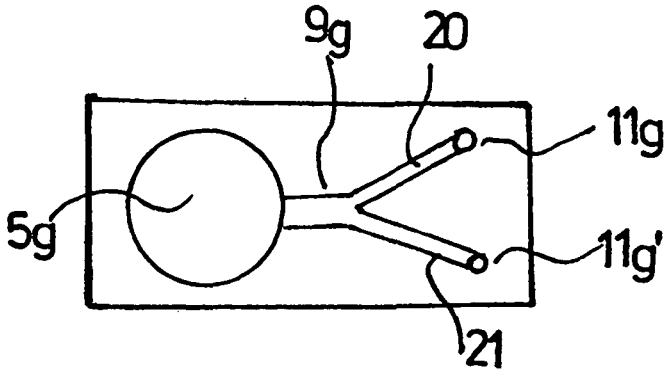

FIG. 12 shows a storage device with a supply chamber 5*g* and transport path 9*g*. The transport path branches into sections 20 and 21, wherein the section 20 leads to an outlet opening 11*g* and the section 21 to an outlet opening 11*g*'. The transport path in this case carries out the function of a fluid distributor.

Figure 13:
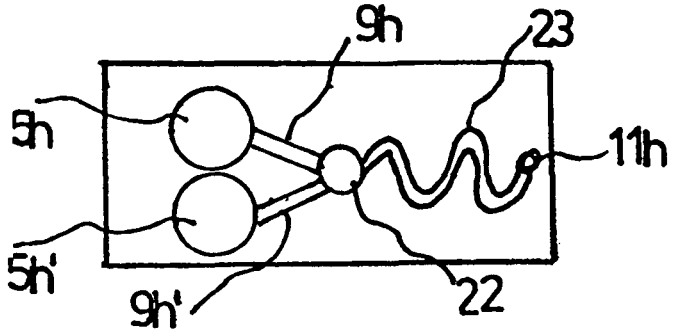

The storage device shown in FIG. 13 has two supply chambers 5*h* and 5*h*'. Transport paths 9*h* and 9*h*' lead to a mixing chamber 22 from which a common transport path section 23 leads to an outlet opening 11*h*. The transport path section 23 is meander-shaped and supports the mixing of the two fluids. Accordingly, the transport path carries out the function of a fluid mixer.

If, for example, the supply chamber 5*h* is filled with a fluid in the form of a reaction fluid or sample into the supply chamber 5*h*' with a fluid serving for the transport, for example, air or gas, the transport path can serve for the exact metering and further transportation of a defined quantity of fluid. In this case, the reaction fluid or sampling quantity is transferred in a first step into the transport duct until, for example, it reaches the through opening 11*h* which, in the case of a transparent flow cell consisting of a transparent plastics material, can be controlled through visual observation. The pressure application to the reaction is then interrupted and the transport fluid in the chamber 5*h*' is subjected to a pressure application. This leads to the further transportation of the fluid present in the transport path 23 and thus, to the further transportation of a defined reaction quantity. By means of locking elements, this procedure can be repeated as often as necessary until the supply chambers are completely empty.

Figure 14:
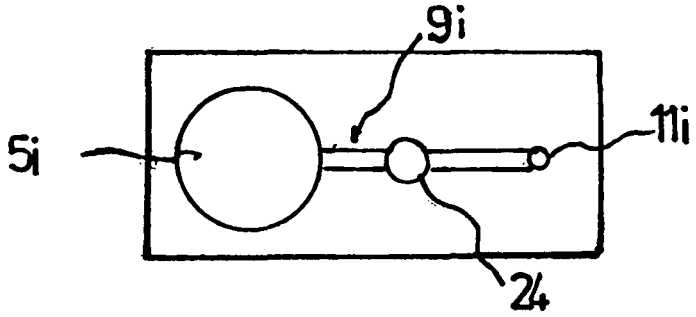

A storage device illustrated in FIG. 14 has a supply chamber 5*i* and a transport path 9*i*, as well as an intermediate container arranged in the transport path which is coated on the inside with a dry reaction material. If the fluid flows through the intermediate container 24, whose interior space is only accessible by the fluid, or is only accessible over the transport path, as is the case with the transport path, the dry reaction material is at least partially dissolved and transported in the fluid. Advantageously, the accessible interior space of the intermediate container can be adjusted so as to be very flat in accordance with the liquid pressure which acts and is adjustable through the pressure application 14 or adjustment by the locking element 16. Also, the dissolution behavior of the dry reacting material can be influenced in the desired manner.

Figure 15:
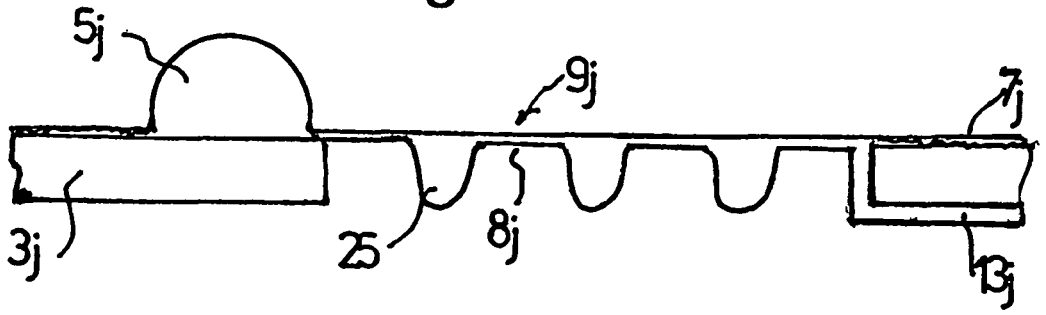
FIG. 15 is an illustration of a storage device according to the invention with a transport path which includes several intermediate containers, in a side view.

A storage device illustrated in FIG. 15 with a supply chamber 5*j* contains several containers 25 in a transport path 9*j*, wherein several of the containers may be filled with, for example, different dry reaction materials.

The embodiments of transport paths illustrated in FIGS. 11 through 15 can be combined with each other. The storage device thereby assumes the function of a flow cell. In the extreme case, a following processing device may not provide any flow cell functions such as, for example, an electrical or electrochemical sensor arranged, for example, following the storage device.

Figure 16:
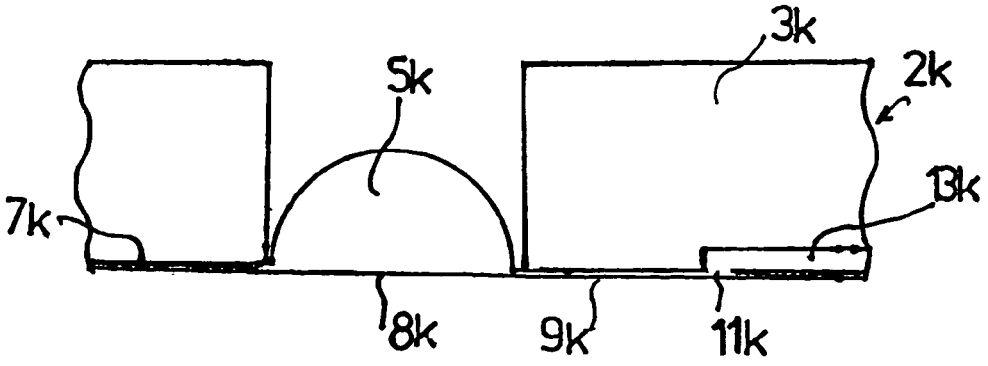
FIG. 16 shows another embodiment for a storage device according to the invention.

A storage device illustrated in FIG. 16 with a storage chamber 5*k* is connected to a flow cell 2*k*. A base plate 3*k* of the flow cell 2*k* is arranged on a foil 7*k* through bulges formed the supply chamber 5*k*. The foil 7*k* covers a duct 13*k* which is formed in the base plate 3*k*, wherein the duct 13*k* is usually in connection with a transport path 9*k* of the storage device covers a duct 13*k* which is formed in the base plate 3*k*, wherein the duct 13*k* is in connection with a transport path 9*k* of the transport device through a through opening 11*k*.

A cover foil corresponding to foil 4 could be arranged n the side of the base plate facing away from the duct 13 and several ducts could be formed in this location which, as seen in projection, could intersect with the duct 13. Consequently, additional functions can be achieved with the same manufacturing effort of the flow cell.

Since, as is the case here, the thickness of the base plate 3*k* is greater than the height of the supply chamber 5*k*, the chamber is protected against improper manipulation, particularly when the storage device is stacked for storage. The manipulation of the storage device becomes safer as a result.

Figure 17:
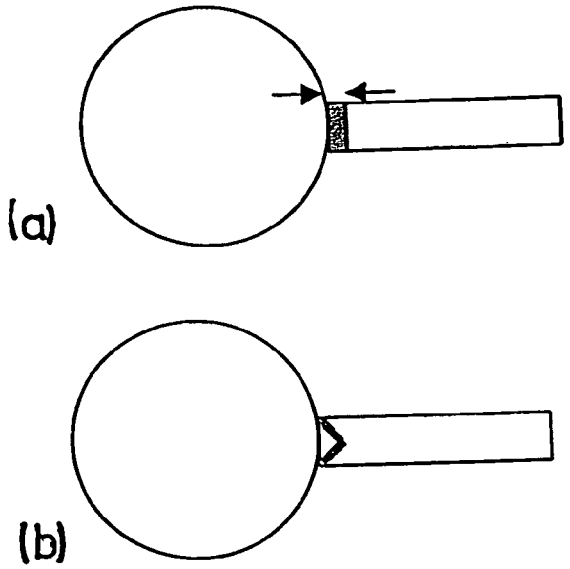
FIG. 17 shows embodiments of intended breaking points.

FIG. 17 shows different embodiments for intended breaking points which are arranged immediately adjacent a supply chamber over the entire width of a transport path and are constructed as welded and/or glued connections between two foils. The dimension of the welded connection indicated by arrows in FIG. 17*a*, preferably between 0.01 and 5 mm, particularly, 0.1 and 2 mm, determines the opening pressure required.

As can be seen in FIG. 17*b*, the shape of the intended breaking point can deviate from a rectangle and may have, for example, the arrow shape illustrated in this Figure. In this manner, welding seams having greater widths which are easier with respect to manufacturing technology, can be produced without a proportional increase with the width of the opening pressure required.

Figure 18:
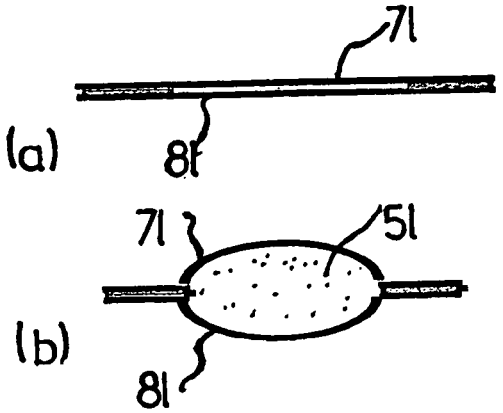
FIG. 18 is an illustration of an embodiment of a supply chamber with a storage device according to the present invention.

FIG. 18 shows a supply chamber 5*l* formed by foils 7*l* and 8*l*; in the state illustrated in FIG. 18*a*, the foils 7*l* and 8*l* rest against each other and the volume included by the foils is at zero. In the filled state according to FIG. 18*b*, the foils 7*l* and 8*l* are expanded in accordance with the degree of filling, as is the case in a filled container. The inclusion of the filling quantity takes place through closing of the last welding seam. Advantageously, the supply chamber can be completely emptied and the foils for emptying does not increase with the degree of emptying, as is the case in the above-described embodiments. Advantageously, the components of the device as described above are manufactured by mass production methods and the described foils are formed by means of deep-drawing. Base plates are produced by injection molding and gluing or welding is used as connecting technologies. Suitable materials are especially plastics materials, particularly synthetic foils, but also metals and metal foils and/or composite materials, such as, for example, conductor plate material.

The invention claimed is:

1. Microfluidic storage device comprising: at least one supply chamber (5) for a fluid (1), the supply chamber being formed by bulging a foil (7) or diaphragm (19); an oblong transport path (9) which extends from the supply chamber (5) to an opening (11) of the storage device for transporting fluid from the supply chamber (5) to the opening (11) of the storage device in a longitudinal direction of the transport path (9); and an intended breaking point (10) that seals and separates an inner space of the supply chamber (5) from the transport path (9) for forming a chamber opening directly at the supply chamber (5), wherein the intended breaking point (10) is adjacent to the supply chamber (5) between the supply chamber (5) and the oblong transport path (9) over the entire width of the oblong transport path (9), wherein prior to forming the opening of the supply chamber (5) the transport path (9) has an inner volume of zero, and wherein the transport path (9) is expandable in accordance with the fluid flow emerging from the chamber opening formed by the breaking point (10) and progressively forms a transport duct (15) whereby the fluid is metered without bubbles out of the opening (11) of the storage device in response to pressure applied on the supply chamber to break the intended breaking point, wherein the transport path (9) has duct walls that rest against each other without a rupturable connection between them.

2. Storage device according to claim 1, wherein the transport path (9) is unlockable by contact with the fluid (1) itself which emerges from the supply chamber (5).

3. The storage device according to claim 1, wherein the transport path (9) comprises duct walls which rest against each other or are placeable against each other, wherein at least one duct wall can be deformed by the fluid (1) during formation of the transport duct (15).

4. The storage device according to claim 3, wherein the wall is expandable by the fluid (1) for forming the transport duct (15).

5. The storage device according to claim 3, wherein the duct walls are each formed by a foil (7, 8) or by a foil (7) and a stiff plate (3).

6. The storage device according to claim 5, wherein the foils (7, 8) or the foil (7) and the plate (3) are, in an area of the transport path (9), not connected with each other or are connected less strongly with each other than in adjacent areas.

7. The storage device according to claim 6, wherein the storage device is integrated in a microfluidic processing device (2).

8. The storage device according to claim 1, wherein the transport path (9*g*) has several parallel sections (20, 21) that lead from a distributor chamber to several openings (11*g*, 11*g*').

* * * * *